US007160000B2

(12) United States Patent
Eldridge et al.

(10) Patent No.: US 7,160,000 B2
(45) Date of Patent: Jan. 9, 2007

(54) COLLAPSIBLE FRAME DEVICE AND SYSTEM

(76) Inventors: Kathleen A. Eldridge, 2361 Fix Rd., Grand Island, NY (US) 14072; Timothy E. Brown, 2361 Fix Rd., Grand Island, NY (US) 14072

( * ) Notice: Subject to any disclaimer, the term of this patent is extended or adjusted under 35 U.S.C. 154(b) by 107 days.

(21) Appl. No.: 10/873,277

(22) Filed: Jun. 23, 2004

(65) Prior Publication Data

US 2004/0246725 A1 Dec. 9, 2004

Related U.S. Application Data

(63) Continuation-in-part of application No. 10/373,303, filed on Feb. 26, 2003, now abandoned.

(51) Int. Cl.
*F21V 21/14* (2006.01)

(52) U.S. Cl. ..... 362/250; 360/220; 360/806

(58) Field of Classification Search ..... 362/250, 362/239, 220, 249, 806, 252, 449, 450
See application file for complete search history.

(56) References Cited

U.S. PATENT DOCUMENTS 4,523,260 A * 6/1985 Duncan ..... 362/121
4,890,206 A * 12/1989 Lee ..... 362/227
4,995,181 A * 2/1991 Wolf ..... 40/714
6,234,650 B1 * 5/2001 Kincade ..... 362/252

* cited by examiner

*Primary Examiner*—Renee Luebke
*Assistant Examiner*—Gunyoung T. Lee

(57) ABSTRACT

A unique, collapsible light display frame and kit therefore is disclosed formed from a plurality of pivotally connecting elongate members having segments which can be removed for changing dimensions, and holes which enable connection of the members in a variety of different sized and shaped, generally polygonal forms, holes enabling the connection of strings of mini-lights thereto within the geometric form of the frame.

18 Claims, 5 Drawing Sheets

COLLAPSIBLE FRAME DEVICE AND SYSTEM

The present invention relates to decorative structures for displaying lights and the like, particularly to durable collapsible decorative frames and a decorative light display system. This application is a continuation-in-part of U.S. application Ser. No. 10/373,303 filed Feb. 26, 2003 now abandoned.

BACKGROUND OF THE INVENTION

It's a common custom to decorate doors, windows, mirrors and the like of homes and businesses by framing them with ornamental light displays during religious and various other holiday celebrations. Generally such decoration involves arranging decorative strings of lights around the frame of such door, window or mirror to outline the door or window, with special displays such as wreaths, symbols or the like being arranged within the boundaries of the lighted outline. The string of lights is typically arranged in a polygonal design, such as a square, rectangle or the like, and typically the light arrangement is only used for a few weeks each year then dismantled and stored for use the following year.

Typically such display arrangements, involve a system of attaching fasteners such as clips, hooks or the like to existing frames of the doors, windows, mirrors and the like, then hooking, clipping, taping or the like a string of lights to the fasteners to form the desired display. Typically, desirable strings of lights are manufactured with mini-light sockets 4–10 inches apart, with each light socket containing a flexible hook for fastening to a supporting structure. In outdoor installations, consideration must be given to the effect of weather and generally each light socket is desirably fastened to the existing frame to prevent wind, snow, rain or the like from excessively jostling the sockets and breaking or damaging the bulbs or wiring. Such arrangements are generally inconvenient and tedious to install, particularly outdoors when the weather is bad and the yearly attachment, removal and re-attachment of clips, fasteners and tape tend to damage the door, window or mirror frames and require constant maintenance. Once removed strings of lights tend to be stored together in common bundles, and since they are commonly of different lengths and different distances between light sockets, tend to be easily mistaken during installation, adding to the effort of installation.

Windows, doors and mirrors are generally rectangular, but are of different sizes and can be domed and/or of different polygonal shapes. An object of the present invention is to provide a frame kit and system for enabling the assembly of a collapsible, dimensionally adjustable frame, suitable for outlining windows, doors, mirrors and the like, in various polygonal shapes and enabled for mounting a string of display lights.

BRIEF SUMMARY OF THE INVENTION

The invention generally comprises a unique collapsible frame with or without lights mounted thereto. The frame comprises a dimensionally adjustable, collapsible, rigid structure, comprising four through six elongate interconnecting members, two of which comprise an "L" shaped end. Each elongate member comprises a plurality of removable segments along its length, which can be conveniently removed from the member to shorten the length of the member to a particular defined desired length. Each elongate member comprises a plurality of spaced openings along its length, sized and positioned to engage a bulb, socket, hook or the like for attaching a string of lights thereto. Segments of an elongate member comprise means for rotatably connecting said segment to a desired mating means at an end of a further elongate member to which it may connect.

In one embodiment of the invention, an elongate member is formed from wood and the wood is perpendicular striated in defined measured segments along its length for convenient measured shortening of the length of such member by breaking or cutting off one or more segments to the desired length. In another embodiment, an elongate member is formed from plastic, similarly comprising defined measured segments which can be removed by breaking, cutting or mechanically detaching one or more segments.

In the formation of a frame of the invention, the two elongate members comprising "L" shaped ends are arranged opposite each other, the sides of the "L" arranged about parallel to each other and the legs of the "L" facing inwardly toward the other member, but facing opposite ends thereof. The remaining two through four elongate members, hereinafter referred to as connecting elongate members, connect between the top of the side of the "L" of one "L" member, and the leg of the "L" of the opposing "L" member. The arrangement of the members in a frame thus comprises opposing "L" end members and opposing connecting elongate members.

In a preferred embodiment each of the removable segments comprise an opening sized for engaging bulbs, sockets, hooks or the like of a string of mini-lights, and means for connecting the four through six elongate members co-act with openings arranged at the ends of the members. In one embodiment openings at the ends of the members are aligned and connecting means extend through the aligned openings to connect the ends of the members in a pivotal arrangement.

In one preferred embodiment, thin walled tubular connectors, preferably split, are provided having a ridge at each end, enabled to be compressed to insert through aligned openings then expand to connect the ends of elongate members in a pivotable arrangement, while providing a suitable opening through which a bulb, socket, clip or the like can be inserted. In another embodiment, an elongate member(s) comprises a thin walled, ridged shoulder about an opening which can be compressed to insert through an opening of another member with the shoulder comprising a pivot point and the ridge retaining the member to another.

With pivotable connections at the ends as indicated aforesaid, when opposing members of a frame are of appropriate length, from connecting point to connecting point, a frame can be collapsed within its plain to form a narrow elongate structure for convenient storage, without removal of light sockets from openings in the frame wherein they have been installed.

In one embodiment, there are four connecting elongate members forming a quadrilateral figure, of variable complimentary interior angles.

In another four elongate member embodiment, one of the connecting members is curved but the distance between connecting openings at its ends is the same as the distance between connecting openings of an opposing generally straight connecting member. Such embodiment enables formation of a frame in the general form of a domed rectangle, yet maintains the ability to collapse the frame. In still another embodiment both connecting members are curved to enable the formation of a generally oval frame.

In a five elongate member embodiment, comprising three connecting members and two "L" end members, two connecting members are arranged opposite the third connecting member enabling the formation of a generally pentagonal frame.

In another embodiment there are six elongate members, wherein two connecting members are arranged on each opposing side to equal lengths. Such arrangement enables the formation of generally hexagonal figures.

These and other arrangements of the invention will be apparent from the following detailed description of the invention.

DETAILED DESCRIPTION OF THE INVENTION

Figure 1:
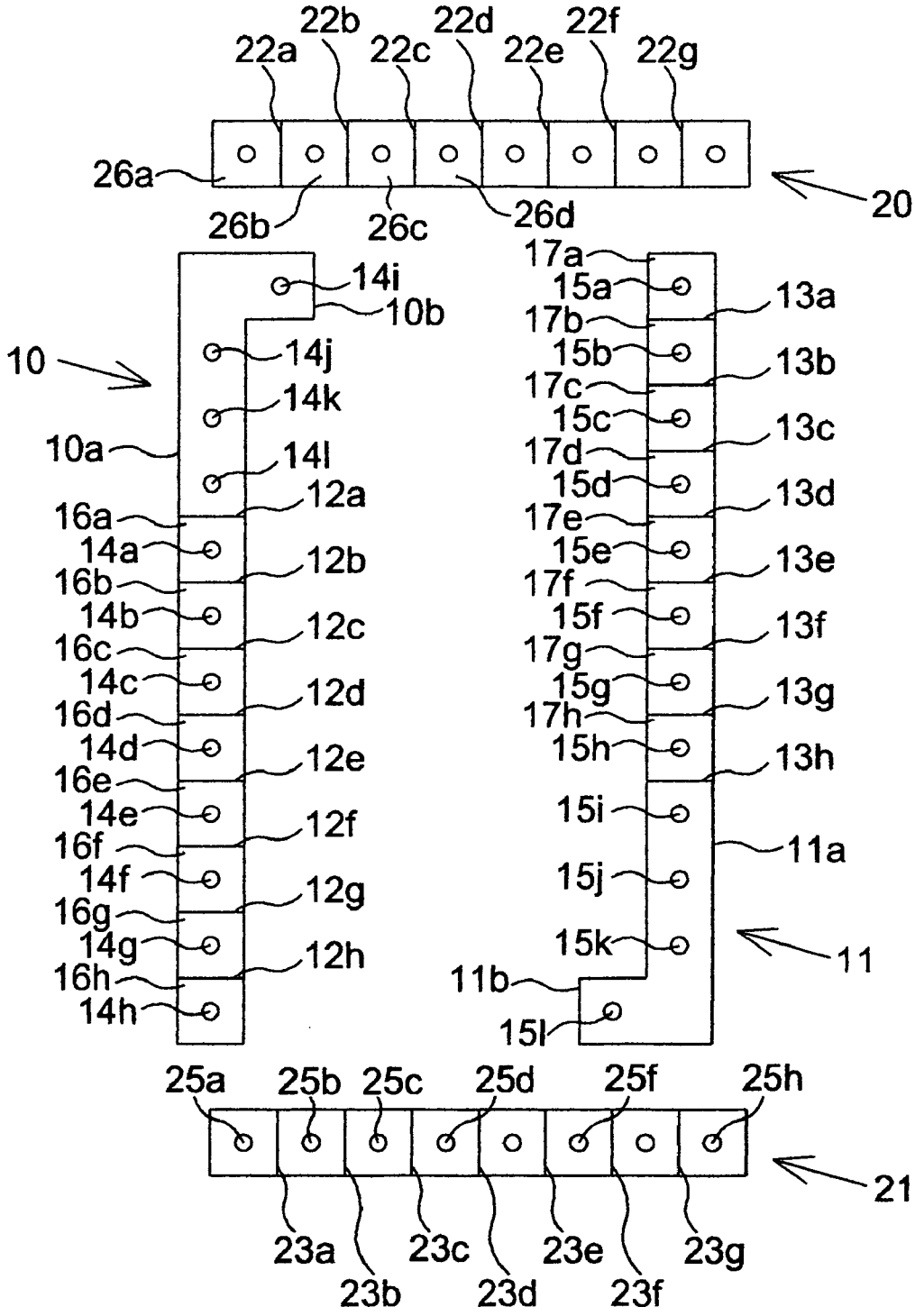
FIG. 1 is an exploded top plan view of one embodiment of the invention.

At the outset, it should be clearly understood that like reference numerals are intended to identify the same structural elements, portions or surfaces consistently throughout the several drawing figures as such elements, portions or surfaces may be further described or explained by the entire written specification, of which this detailed description is an integral part. Unless otherwise indicated, the drawings are intended to be read together with the specification, and are to be considered a portion of the entire written description of this invention.

Figure 2:
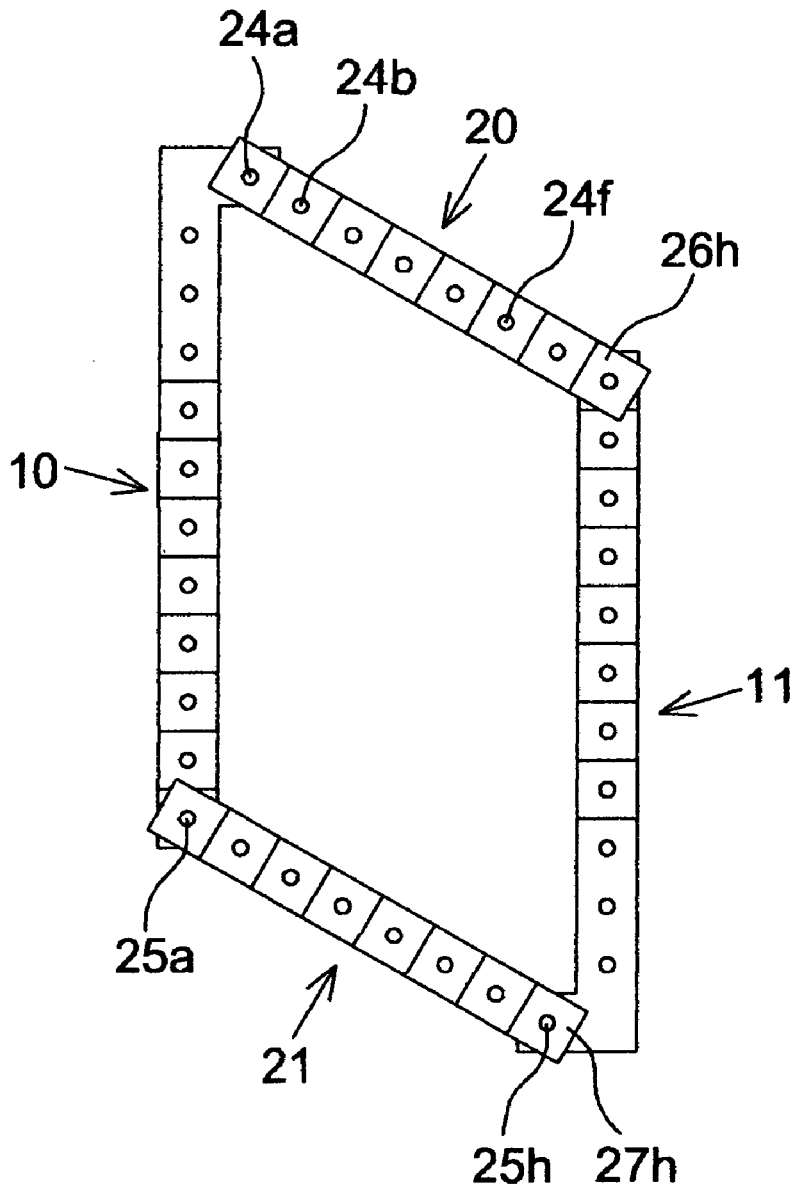
FIG. 2 is a top plan view of the assembled embodiment of FIG. 1 wherein the frame is partially collapsed.
Figure 2A:
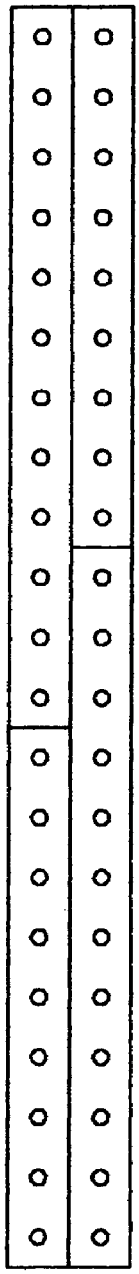
FIG. 2A is a top plan view of the assembled embodiment of FIG. 1 wherein the frame is fully collapsed.

FIGS. 1–2A illustrate an arrangement of the invention comprising four elongate members formed from wood, with etched perpendicular striations defining measured segments along each elongate member's length. Therein opposing "L" end members 10 and 11 are illustrated as comprising elongate sides 10*a* and 11*a*, and legs 10*b* and 11*b* respectively. In this embodiment, etched striations 12*a*–*h* and 13*a*–*h* are illustrated as defining segments 16*a*–*g* and 17*a*–*g*, each defined segment on a member being equal in size to adjoining defined segments, and each defined segment on one "L" end member being equal in size to a defined corresponding segment on the opposing "L" end member. The etched striations illustrated on the top surface of the "L" end members comprise surface lesions in the wood forming the "L" end members and enable convenient removal of a segment from the length of the member. Corresponding lesions may be provided on the bottom surface, to enable even more convenient removal of a segment. Each segment, and the "L" end of the member is illustrated as comprising openings 14*a*–*l* and 15*a*–*l* respectively. In the illustrated embodiment the openings are shown in a preferred embodiment as being about equal size and as being about centered in a segment.

Elongate connecting members 20 and 21 are illustrated in a preferred embodiment as being dimensioned in width about the same as the "L" end member, and comprising etched striations 22*a*–*g* and 23*a*–*g* respectively, forming segments 26*a*–*h* and 27*a*–*h* sized to about the same size of the segments of the "L" end members. As with the "L" end members, the segments in connecting members 20 and 21 are illustrated as containing openings 24*a*–*h* and 25*a*–*h* respectively, shown in a preferred embodiment as being of about equal size and as being about centered in a segment.

FIG. 2 illustrates a frame of the invention in assembled quadrilateral form, in this case being partially collapsed to illustrate pivoting about connectors 29. FIG. 2A illustrates the frame of FIG. 2 fully collapsed.

Figure 3:
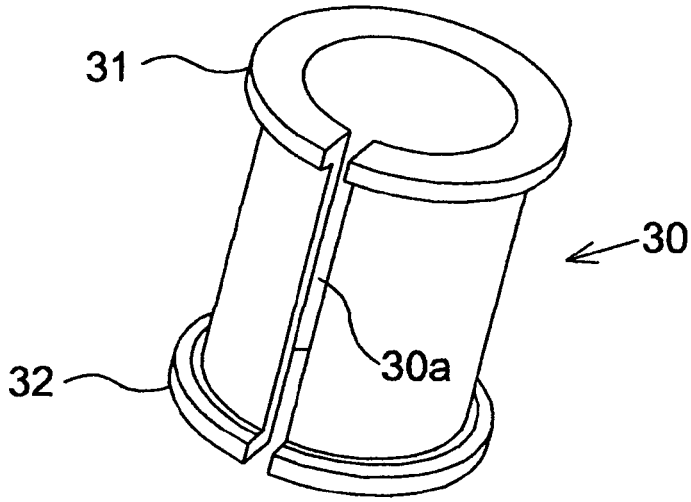
FIG. 3 illustrates a perspective view of a thin walled, split tubular connector of the invention.

FIG. 3 illustrates a perspective view of a thin walled, split tubular connector 30 of the invention, comprising a hollow thin walled resilient tube having a longitudinal split 30*a* and ridges 31 on each end engaging a connecting member to an "L" end member phantom.

Figure 4:
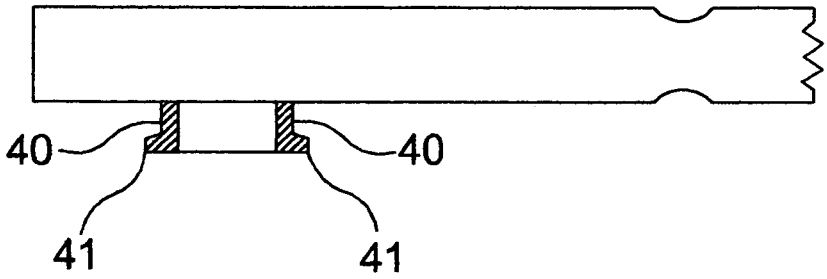
FIG. 4 illustrates a connecting member comprising a split, thin walled connector.

FIG. 4 illustrates a side view of connecting member comprising a split, thin walled shoulder 40 having ridge 41, about an opening in a segment which can be compressed to insert through an opening of an adjacent member, shoulder 40 forming the pivot and the ridge 41 retaining the members engaging to each other.

Figure 5:
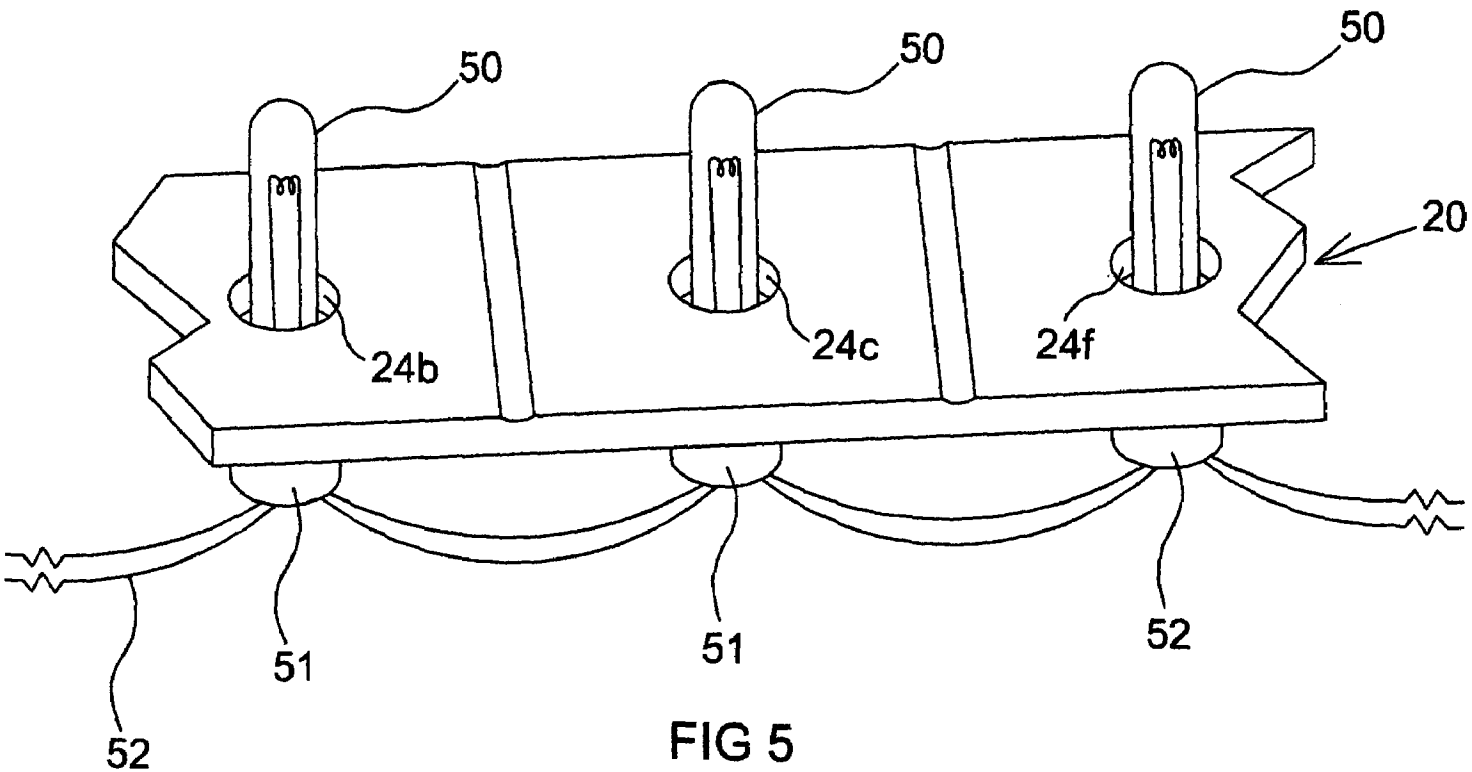
FIG. 5 illustrates a partial sectional, partial perspective view of an elongate member with mounted lights.

FIG. 5 illustrates a partial sectional, partial perspective view of an elongate member 20 of the invention with a partial string 52 of mini-lights having sockets 51 with bulbs 50 extending through openings 24*b*–*f* of the elongate member for display.

It should be understood, that an elongate member can be of any convenient width, length and thickness, and may comprise holes, tabs, hooks or the like for mounting a finished frame. In a preferred embodiment the frame is dimensioned as narrow as practical so that it does not dominate the effect of the light display.

Further, though the elongate members of the invention may be connected using the preferred connectors of the invention, it is contemplated that the members can also be connected using a simple bolt and nut arrangement or the like.

We claim:

1. A collapsible light display frame comprising:

two elongate "L" end members, each said "L" end member having a first end and an opposite "L" shape formed end, each end of said "L" end members comprising an opening arranged to align with a mating opening of an elongate connecting member;

two elongate connecting members, said elongate connecting members comprising openings at opposite ends thereof arranged for aligning with a mating opening of an elongate "L" end member;

means for connecting said elongate connecting members to said elongate "L" end members through aligned mating openings;

wherein said elongate connecting members and said elongate "L" end members comprise a plurality of removable segments along their length, said segments being striated in defined measured lengths to enable one of cutting or breaking off a segment from said "L" end members, and having an opening sized to mount at least one of means for mounting an elongate connecting member to an elongate "L" member, bulb, socket or hook of a mini-light.

2. The display frame of claim 1 wherein an opening is sized to mount a bulb of a string of mini-lights.

3. The display frame of claim 1 wherein an opening is sized to mount a socket of a string of mini-lights.

4. The display frame of claim 1 wherein each removable segment comprises an opening to mount at least one of bulb, socket and hook of a string of mini-lights.

5. The display frame of claim 1 comprising more than two elongate connecting members.

6. The display frame of claim 1 wherein said means for connecting comprises a thin walled, tubular member sized to pass through said aligned mating openings.

7. The display frame of claim 6 wherein opposite ends of said tubular member comprise engaging ridges arranged to connect adjoining elongate members at aligned mating openings.

8. The display frame of claim 6 wherein said tubular member is sized to enable passage of at least one of bulb, socket and hook of a mini-light therethrough.

9. The display frame of claim 1 wherein said means for connecting comprises a resilient shoulder arranged about an opening in a segment of a first elongate member arranged to insert through an aligned mating opening of an adjacent elongate member and retain the elongate members connected.

10. The display frame of claim 1 comprising a mini-light arranged to extend through an opening in a segment.

11. The display frame of claim 1 wherein an elongate "L" end member is striated about perpendicular to the length of a leg of said "L" end member.

12. A kit comprising:

two elongate "L" end members, each said "L" end member having a first end and an opposite "L" shape formed end, each said end comprising an opening arranged to align with a mating opening of a connecting member;

two elongate connecting members, said elongate connecting members comprising openings at opposite ends thereof arranged for aligning with a mating opening in an elongate "L" end member;

wherein said elongate connecting members and said elongate "L" end members comprise a plurality of removable segments along their length, said segments being striated in defined measured lengths to enable one of cutting or breaking off a segment from said "L" end members, and having an opening sized to mount at least one of means for mounting an elongate connecting member to an elongate "L" member, bulb, socket or hook of a mini-light.

13. The kit of claim 12 comprising means for connecting said connecting members to said elongate "L" end members through aligned mating openings.

14. The kit of claim 13 wherein said means for connecting comprises a tubular connector sized to pass through said aligned mating openings.

15. The kit of claim 12 comprising a string of mini-lights.

16. The display frame of claim 12 wherein said elongate "L" end member is striated about perpendicular to the length of a leg of said "L" end member.

17. A system for displaying a plurality of polygonal lights comprising:

providing two elongate "L" end members, each said "L" end member having a first end and an opposite "L" shape formed end, said elongate "L" end members comprising a plurality of removable segments along their length and segments comprising openings sized to mount at least one of bulb, socket or hook of a mini-light, each end of said "L" end members comprising an opening arranged to align with a mating opening of an elongate connecting member;

providing two elongate connecting members, said elongate connecting members comprising a plurality of removable segments along their length, said segments being striated in defined measured lengths to enable one of cutting or breaking off a segment from said "L" end members, and having an opening sized to mount at least one of bulb, socket or hook of a mini-light, said elongate connecting members comprising openings at opposite ends thereof arranged for aligning with a mating opening of an elongate "L" end member;

providing means for connecting said elongate connecting members to said elongate "L" end members through aligned mating openings;

removing segments from at least one of said elongate connecting members and "L" end members to a predetermined length;

aligning said elongate connecting members between elongate "L" end members and connecting said elongate connecting members to said elongate "L" end members at aligned mating openings.

18. The display frame of claim 17 wherein said elongate "L" end member is striated about perpendicular to the length of a leg of said "L" end member.

* * * * *